US006448870B1

(12) United States Patent
Hiroshima et al.

(10) Patent No.: US 6,448,870 B1
(45) Date of Patent: Sep. 10, 2002

(54) DIELECTRIC FILTER, DIELECTRIC DUPLEXER, AND COMMUNICATION APPARATUS USING THE SAME

(75) Inventors: Motoharu Hiroshima; Shohachi Nishijima; Hideyuki Kato, all of Ishikawa-ken; Kikuo Tsunoda, Mishima-gun, all of (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/580,299

(22) Filed: May 26, 2000

(30) Foreign Application Priority Data

May 27, 1999 (JP) ..... 11-147992
Mar. 28, 2000 (JP) ..... 2000-089253

(51) Int. Cl.[7] ..... H01P 1/205
(52) U.S. Cl. ..... 333/134; 333/202; 333/206
(58) Field of Search ..... 333/134, 219.1, 333/222, 206, 202

(56) References Cited

U.S. PATENT DOCUMENTS 4,431,977 A * 2/1984 Sokola et al. ..... 333/206
4,612,667 A 9/1986 Hansen ..... 455/98
5,684,439 A * 11/1997 Vangala ..... 333/202

FOREIGN PATENT DOCUMENTS

| | | | |
|---|---|---|---|
| EP | 0520641 A1 | 6/1992 | ..... H01P/1/205 |
| EP | 0829914 A2 | 3/1998 | ..... H01P/1/205 |
| EP | 0829915 A2 | 3/1998 | ..... H01P/1/213 |
| EP | 0851526 A2 | 7/1998 | ..... H01P/1/213 |
| EP | 0853349 A1 | 7/1998 | ..... H01P/1/205 |

OTHER PUBLICATIONS

European Search Report dated Jan. 16, 2002.

* cited by examiner

*Primary Examiner*—Robert Pascal
*Assistant Examiner*—Dean Takaoka
(74) *Attorney, Agent, or Firm*—Ostrolenk, Faber, Gerb & Soffen, LLP

(57) ABSTRACT

A dielectric filter and a dielectric duplexer adapted to two frequency bands formed by using a single component are disclose, in addition to a communication apparatus using the same. In this case, since a dielectric block used as the single component can be easily molded and grasped, production efficiency can be enhanced. The dielectric duplexer adaptable to two frequency bands is formed by disposing inner-conductor-formed holes acting as λ/2 resonators and λ/4 resonators in the single dielectric block.

15 Claims, 8 Drawing Sheets

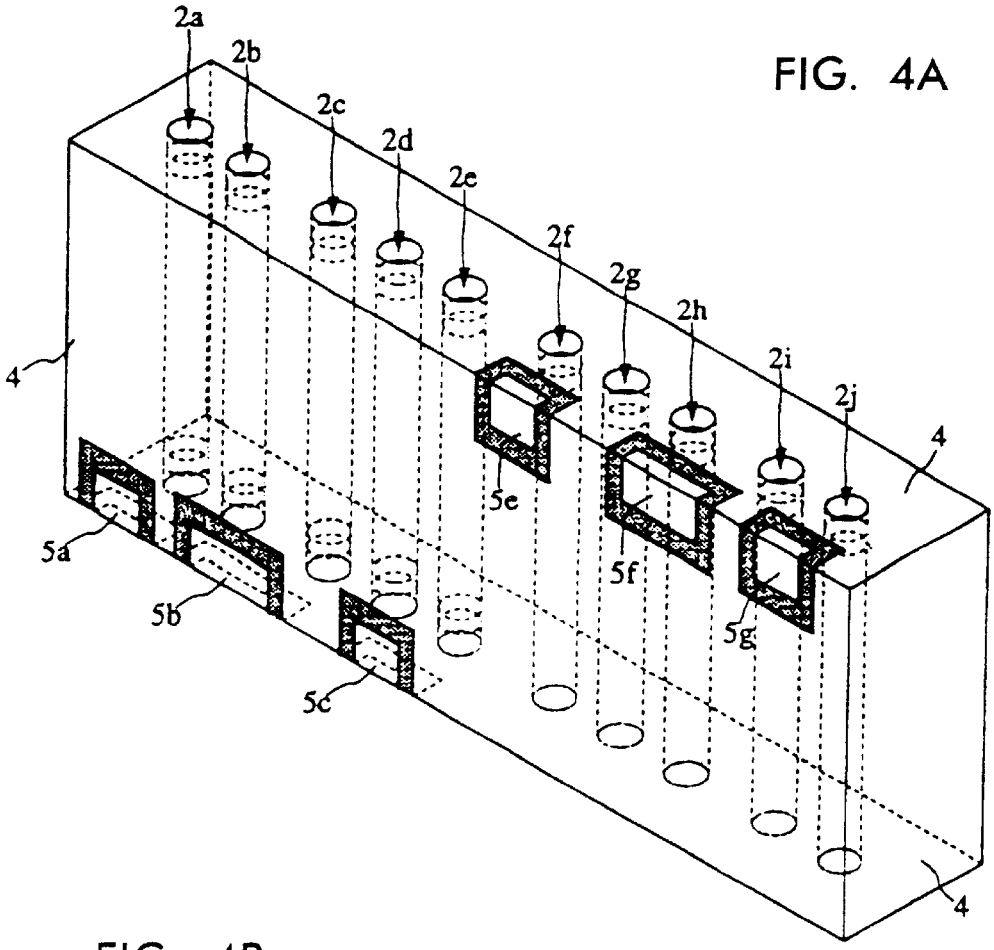
FIG. 4A
FIG. 4B
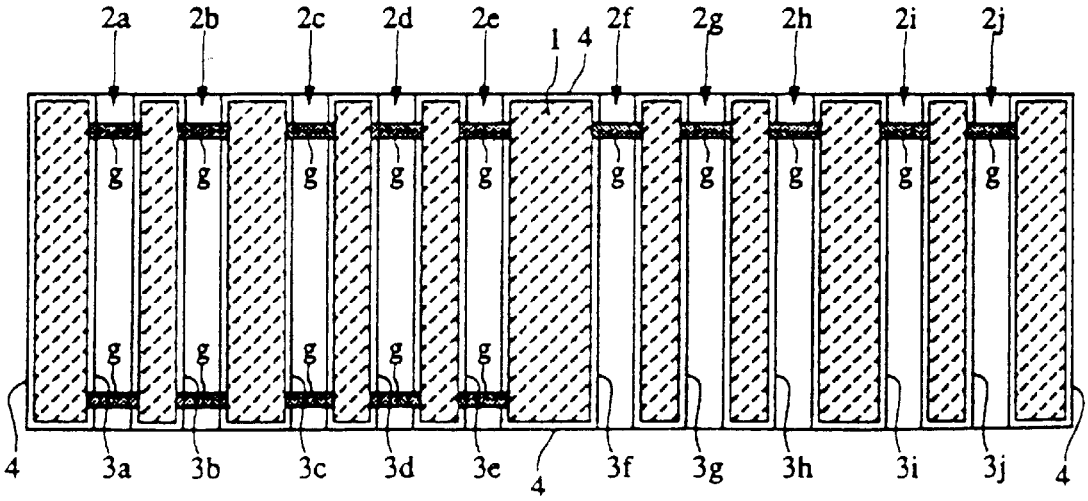

DIELECTRIC FILTER, DIELECTRIC DUPLEXER, AND COMMUNICATION APPARATUS USING THE SAME

BACKGROUND OF THE INVENTION

1. Field of the Invention

The present invention relates to dielectric filters and dielectric duplexers, each adapted to at least two frequency bands by using a single component, and the invention also relates to communication apparatuses using the same.

2. Description of the Related Art

Regarding cellular phone systems, for example, an apparatus having a function adaptable to two cellular phone systems by using a single cellular phone terminal is known. In such an apparatus, in order to minimize the number of components, it is necessary to use a single component adaptable to two frequency bands.

For example, when a single dielectric block is used to form a filter adapted to a first frequency band and a filter adapted to a second frequency band, it is possible to form a dielectric filter adaptable to the two frequency bands by using the single dielectric block.

However, when the two frequency bands are far apart from each other, the axial lengths of resonators are significantly different between the filter adapted to the first frequency band and the filter adapted to the second frequency band. As a result, there is a problem in that a rectangular-parallelepiped dielectric block cannot be used to form a dielectric filter. Regarding the problem, for example, a stepped part is produced on the outline of the dielectric block, and a crack is thereby likely to be produced on the stepped part. In addition, since it is difficult to grasp the dielectric block itself or the completed dielectric filter, there is an obstacle caused in an automated production process.

In a filter disclosed in U.S. Pat. No. 5,731,746, a substantially rectangular-parallelepiped dielectric block is used to form two sets of resonators whose resonant frequencies are relatively widely apart from each other. In the structure of the filter, the two sets of the resonators whose axial directions are mutually perpendicular are disposed in the dielectric block so that the resonators resonate with resonant frequencies corresponding to the axial lengths of the resonators.

However, in the case of such a structure in which all the directions in which through-holes forming the resonators are formed are not parallel, a molding metal die used for forming a unit of the dielectric block has a complicated configuration. As a result, production efficiency is extremely deteriorated.

SUMMARY OF THE INVENTION

To overcome the above described problems, one preferred embodiment of the present invention provides a dielectric filter including a single dielectric member, conductor films formed on the single dielectric member and therein to dispose a plurality of $\lambda/2$ resonators resonating at a ½ wavelength, both ends of each of the $\lambda/2$ resonators being either open-circuited or short-circuited, and a plurality of $\lambda/4$ resonators resonating at a ¼ wavelength, one end of each of the $\lambda/4$ resonators being short-circuited, and the other end thereof being open-circuited. In this dielectric filter, the plurality of $\lambda/2$ resonators constitutes a first frequency band filter, and the plurality of $\lambda/4$ resonators constitutes a second frequency band filter.

The arrangement is made in such a manner that the first frequency band filter constituted of the plurality of $\lambda/2$ resonators and the second frequency band filter constituted of the plurality of $\lambda/4$ resonators are formed by using the single dielectric member and the conductor films formed thereon and therein. This arrangement permits the dielectric filter to act as a filter adapted to two frequency bands.

In addition, in the dielectric filter described above, resonance frequencies of the $\lambda/2$ resonators and the $\lambda/4$ resonators may be set at specified values by making line impedances of open-circuited-face sides of the $\lambda/2$ resonators and the $\lambda/4$ resonators different from those of short-circuited-face sides thereof, and lengths of both the $\lambda/2$ resonators and the $\lambda/4$ resonators may be substantially equal.

In addition, in the dielectric filter of the present invention, the dielectric constant of the first frequency band filter comprised of the $\lambda/2$ resonators may differ from the dielectric constant of the second frequency band filter comprised of the $\lambda/4$ resonators. With this arrangement, the frequency ratio between the first filter and the second filter is not limited to a ratio of 1:2 so that the frequency ratio can be set at an arbitrary frequency ratio.

In addition, in this dielectric filter, the plurality of resonators may be formed by dielectric coaxial resonators produced by disposing inner-conductor-formed holes in parallel with each other in a dielectric block. Accordingly, structuring of the dielectric block and formation of the conductor films disposed thereon can be facilitated by disposing the inner-conductor-formed holes acting as the $\lambda/2$ resonators and the $\lambda/4$ resonators in parallel with each other.

Another preferred embodiment of the present invention provides a dielectric duplexer including the dielectric filter described above. For example, two sets of a transmission filter and a reception filter are disposed in a single dielectric block to form an antenna duplexer adaptable to two frequency bands.

Furthermore, according to a third aspect of the present invention, there is provided a communication apparatus including one of the dielectric filter and the dielectric duplexer described above. For example, in the communication apparatus, one of the dielectric filter and the dielectric duplexer having characteristics adapted to two frequency bands is used in a high-frequency circuit section.

BRIEF DESCRIPTION OF THE DRAWINGS

FIG. 4A shows a perspective view of a dielectric duplexer according to a second embodiment of the present invention, and FIG. 4B shows a sectional view thereof;

DESCRIPTION OF THE PREFERRED EMBODIMENTS

A description will be given of the structure of a dielectric duplexer according to a first embodiment of the present invention with reference to FIGS. 1 to 3.

Figure 1A:
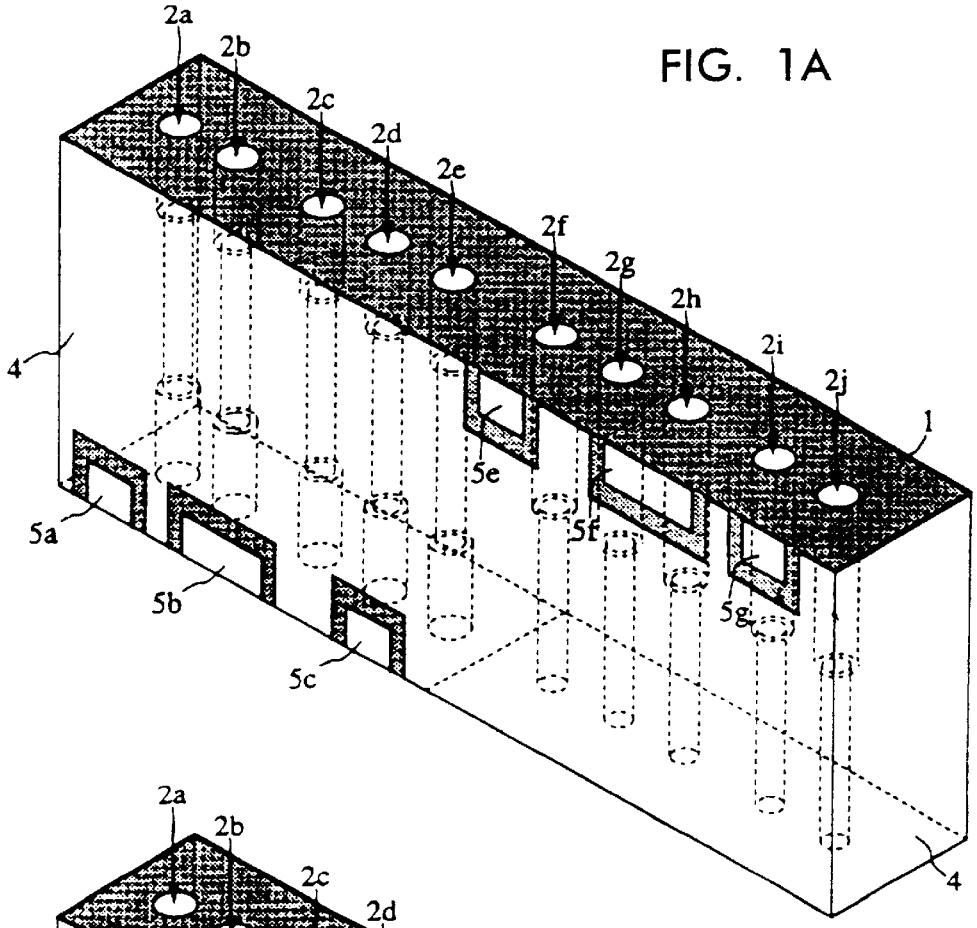
FIGS. 1A and 1B show perspective views of a dielectric duplexer according to a first embodiment of the present invention.
Figure 1B:
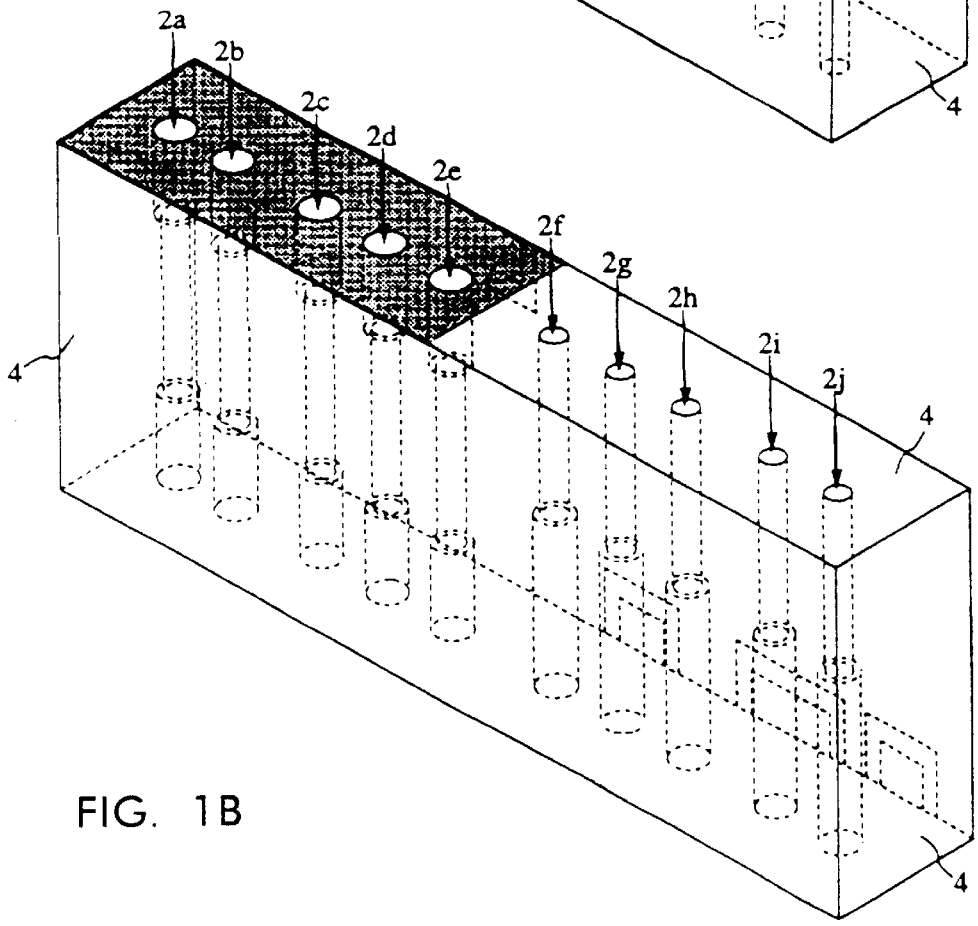

FIGS. 1A and 1B show perspective views illustrating the appearance of the dielectric duplexer. FIG. 1A is a perspective view, in which a dielectric block is in a vertical orientation in such a manner that a surface on which terminal-electrodes are formed is set as the front-left-side surface of the dielectric block, and FIG. 1B is a perspective view in which the dielectric block is turned upside down.

In FIG. 1, reference numeral 1 denotes a substantially rectangular-parallelepiped dielectric block, in which inner-conductor-formed holes indicated by reference numerals 2*a* to 2*j* are disposed in vertical directions in the figure. On the inner surface of each of the inner-conductor-formed holes 2*a* to 2*j*, an inner conductor is formed. On four side surfaces of the dielectric block 1, an outer conductor 4 is each disposed. In addition, on one open face of each of the inner-conductor-formed holes 2*f* to 2*j*, the outer conductor 4 is also disposed so that the outer-conductor-formed faces are used as short-circuited faces. The other open face of each of the inner-conductor-formed holes 2*f* to 2*j* is an open face with no outer conductor formed thereon. Both open faces of the inner-conductor-formed holes 2*a* to 2*e* are open faces having no outer conductors formed thereon.

Furthermore, on the front-left-side surface of the dielectric block 1 shown in FIG. 1A, terminal electrodes 5*a*, 5*b*, 5*c*, 5*e*, 5*f*, and 5*g*, which are isolated from the outer conductor 4, are formed.

With the above-described arrangement, the inner conductors formed in the inner-conductor-formed holes 2*a* to 2*e* act as $\lambda/2$ resonators which resonate at a ½ wavelength, each end of the resonators being open-circuited. In addition, the inner conductors of the inner-conductor-formed holes 2*f* to 2*j* act as $\lambda/4$ resonators which resonate at a ¼ wavelength, one end of each of the resonators being short-circuited.

Figure 2:
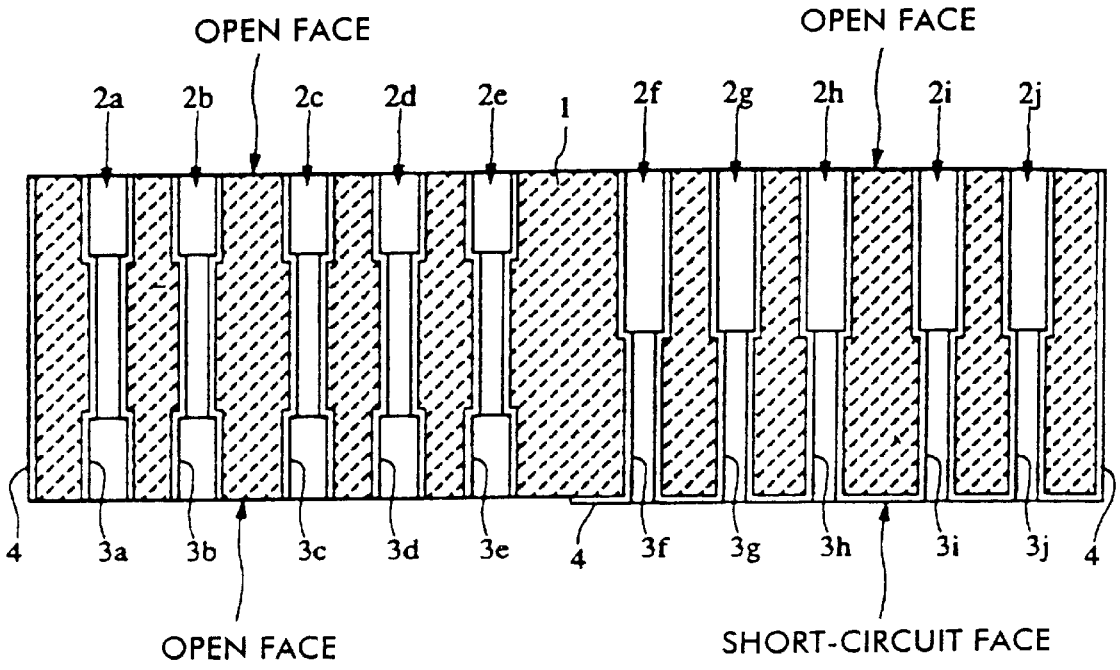
FIG. 2 is a sectional view of the dielectric duplexer.

FIG. 2 is a sectional view taken by a plane passing along the central axes of the inner-conductor-formed holes shown in FIG. 1A. In FIG. 2, on the inner surfaces of the inner-conductor-formed holes 2*a* to 2*j*, inner conductors indicated by reference numerals 3*a* to 3*j* are formed. These inner conductors act as resonance lines. The inner diameters on the open-face sides of the inner-conductor-formed holes 2*f* to 2*j* are made wider than those on the short-circuited-face sides thereof to make the line impedance of the open-face sides smaller than that of the short-circuited-face side. This arrangement causes a difference between resonance frequencies of an even mode and an odd mode occurring between adjacent resonance lines to couple adjacent resonators.

In addition, the inner diameters of the open-face sides of the inner-conductor-formed holes 2*a* to 2*e* are made wider than those of the vicinities of the central parts thereof. Since the central parts of the inner-conductor-formed holes 2*a* to 2*e* are equivalently short-circuited ends, line impedance of the resonance line on each open-face side is different from that of the resonance line on each short-circuited face to couple the adjacent resonators, as shown in the structure of the inner-conductor-formed holes 2*f* to 2*j*.

Not only are the resonators coupled, but also the resonator lengths, which are the lengths of the inner-conductor-formed holes, are fixed, and the resonant frequencies of the resonators are set at specified values, by making the line impedances of the resonance lines different between each open-face side and each short-circuited face.

Figure 3:
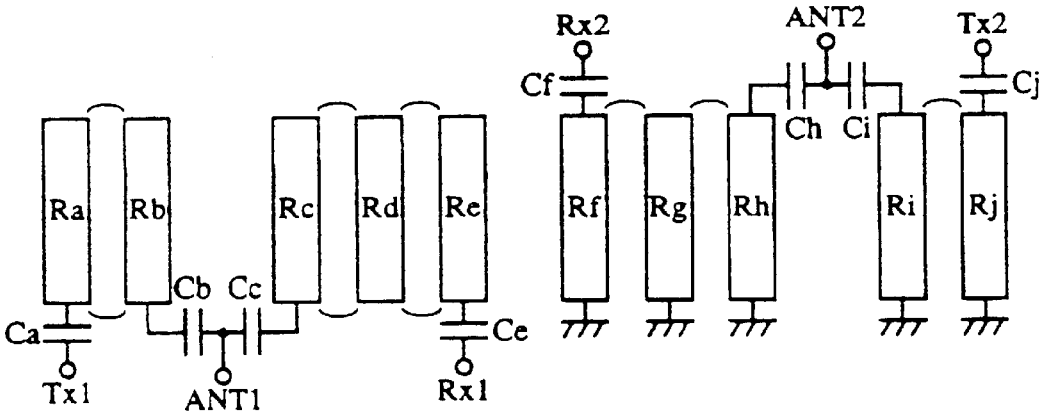
FIG. 3 is an equivalent circuit diagram of the dielectric duplexer.

FIG. 3 is an equivalent circuit diagram of the dielectric duplexer. In this figure, reference numerals Ra to Rj denote the resonators formed by the inner-conductor-formed holes 2*a* to 2*j* shown in FIG. 1. Reference character, Ca denotes a capacitor generated between the vicinity of one of the open faces of the inner conductor formed on the inner surface of the inner-conductor-formed hole 2*a* and the terminal electrode 5*a*, and reference character Ce denotes a capacitor generated between the vicinity of one of the open. faces of the inner conductor formed on the inner surface of the inner-conductor-formed hole 2*e* and the terminal electrode 5*c*. In addition, reference characters Cb and Cc denote capacitors generated between the vicinity of one of the open faces of the inner conductor formed on the inner surface of each of the inner-conductor-formed holes 2*b* and 2*c* and the terminal electrode 5*b*. Similarly, reference character Cf denotes a capacitor generated between the vicinity of one of the open faces of the inner conductor formed on the inner surface of the inner-conductor-formed hole 2*f* and the terminal electrode 5*e*, and reference character Cj denotes a capacitor generated between the vicinity of one of the open faces of the inner conductor formed on the inner surface of the inner-conductor-formed hole 2*j* and the terminal electrode 5*g*. In addition, reference characters Ch and Ci denote capacitors generated between the vicinity of one of the open faces of the inner conductor formed on the inner surface of each of the inner-conductor-formed holes 2*h* and 2*i* and the terminal electrode 5*f*.

The two-stage resonators Ra and Rb act as a first transmission filter, and the three-stage resonators Rc, Rd, and Re act as a first reception filter. Similarly, the two-stage resonators Ri and Rj act as a second transmission filter, and the three-stage resonators Rf, Rg, and Rh act as a second reception filter.

The terminal electrodes 5*a*, 5*b*, and 5*c* shown in FIG. 1, as shown above, are used as a transmission signal input terminal Tx1, an antenna terminal ANT1, and a reception signal output terminal Rx1, respectively, to form a first dielectric duplexer. In addition, the terminal electrodes 5*e*, 5*f*, and 5*g* are used as a reception signal output terminal Rx2, an antenna terminal ANT2, and a transmission signal input terminal Tx2, respectively, to form a second dielectric duplexer.

For example, the first dielectric duplexer is applied to a cellular phone system PCS using a frequency band of 1800 MHz, and the second dielectric duplexer is applied to a cellular phone system AMPS using a frequency band of 800 MHz.

Next, a description will be given of the structure of a dielectric duplexer according to a second embodiment of the present invention with reference to FIGS. 4A and 4B, and FIG. 5.

FIG. 4A shows a perspective view of the appearance of a dielectric block in a vertical orientation in such a manner that the front-left-side surface of the dielectric block is set as a surface to be mounted on a printed circuit board, and FIG. 4B shows a sectional view taken by a place passing along the central axes of the inner-conductor-formed holes of the dielectric duplexer. Unlike the case of the first embodiment, in the second embodiment, no open faces are formed on the external surfaces of a dielectric block 1, and the open ends of resonance lines are formed inside inner-conductor-formed holes. More specifically, non-inner-conductor-formed portions g are disposed near both open faces of inner-conductor-formed holes 2*a* to 2*e*, and each non-inner-conductor-formed portion g is also disposed near one of the open faces of each of inner-conductor-formed holes 2*f* to 2*j*. On the external surfaces of the dielectric block 1, terminal electrodes 5*a*, 5*b*, 5*c*, 5*e*, 5*f*, and 5*g*, which are isolated from an outer conductor 4, are formed from the front-left-side surface to the upper and lower surfaces shown in FIG. 4A.

Figure 5:
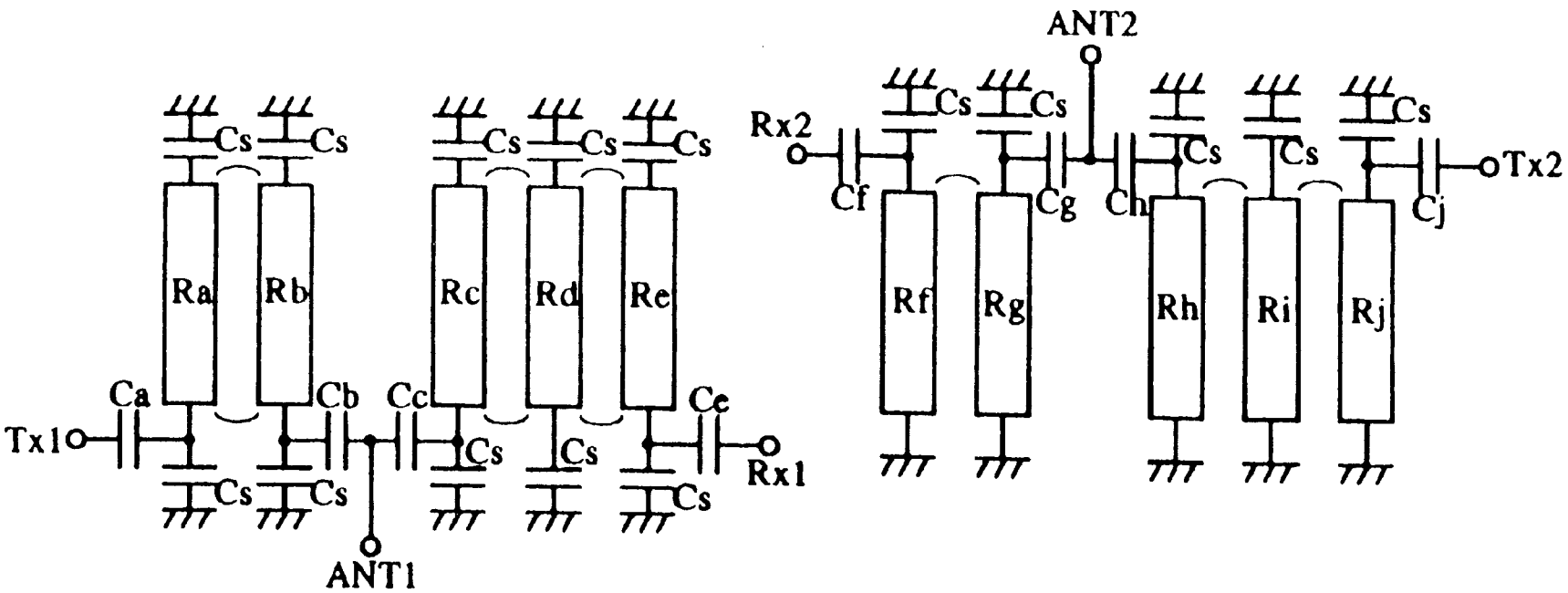
FIG. 5 is an equivalent circuit diagram of the dielectric duplexer of the second embodiment.

FIG. 5 is an equivalent circuit diagram of the dielectric duplexer shown in FIG. 4. In this case, reference characters Ra to Rj denote resonators corresponding to the resonators formed by the inner-conductor-formed holes 2*a* to 2*j* shown in FIG. 4. Reference character Ca denotes a capacitor generated between the vicinity of one of the open ends of an inner conductor 3*a* and the terminal electrode 5*a*, and reference character Ce denotes a capacitor generated between the vicinity of one of the open ends of an inner conductor 3*e* and the terminal electrode 5*c*. Reference characters Cb and Cc denote capacitors generated between the vicinity of one of the open ends of each of inner conductors 3*b* and 3*c*, respectively, and the terminal electrode 5*b*. Similarly, reference character Cf denotes a capacitor generated between the vicinity of one of the open faces of the inner conductor 3*f* and the terminal electrode 5*e*, and reference character Cj denotes a capacitor generated between the vicinity of one of the open faces of the inner conductor 3*j* and the terminal electrode 5*g*. In addition, reference characters Cg and Ch denote capacitors generated between the vicinity of one of the open faces of each of the inner conductors 3*g* and 3*h*, respectively, and the terminal electrode 5*f*. Reference character Cs denotes a stray capacitance generated at each of the non-inner-conductor-formed portions g.

The resonators Ra to Re act as λ/2 resonators whose ends are open-circuited. The resonators Ra and Rb make comb-line coupling via the stray capacitance, and the two-stage resonators are used as a first transmission filter. In addition, the resonators Rc, Rd, and Re similarly make comb-line coupling via the stray capacitance, and the three-stage resonators are used as a first reception filter. The resonators Rf to Rj act as λ/4 resonators. The resonators Rf and Rg make comb-line coupling via the stray capacitance. The two-stage resonators are used as a second reception filter. In addition, the resonators Rh, Ri, and Rj similarly make comb-line coupling via the stray capacitance, and the three-stage resonators are used as a second transmission filter.

Next, a description will be given of the structure of a dielectric duplexer according to a third embodiment of the present invention with reference to FIGS. 6 and 7.

Figure 6:
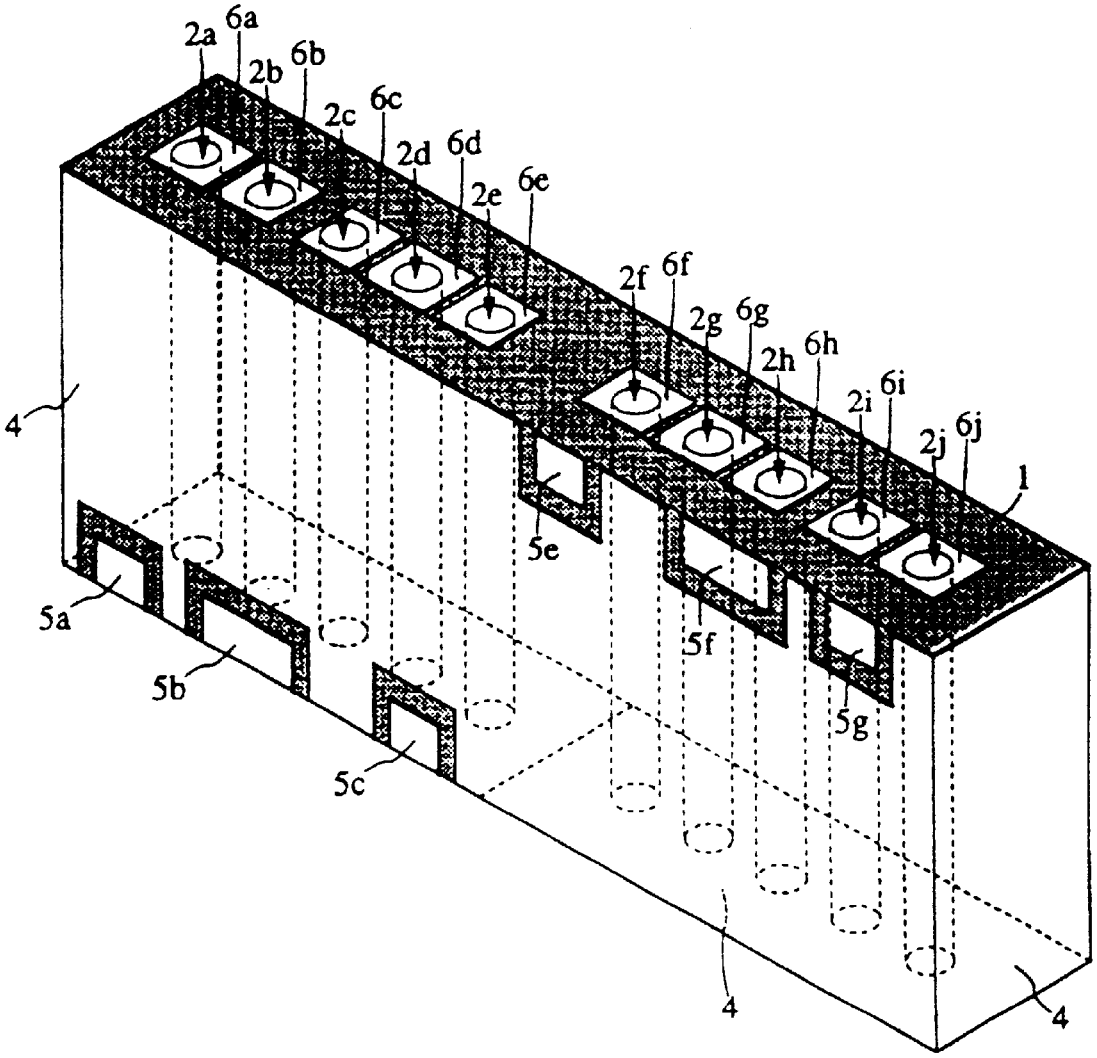
FIG. 6 is a perspective view of a dielectric duplexer according to a third embodiment of the present invention.

FIG. 6 shows a perspective view of the appearance of the dielectric duplexer in a vertical orientation in such a manner that the front-left-side surface is set as a surface to be mounted on a printed circuit board. Unlike the case of the first embodiment, in the third embodiment, widths of the inner diameters of inner-conductor-formed holes 2*a* to 2*j* are fixed, and coupling electrodes 6*a* to 6*j* continuing from inner conductors are formed at one of the open faces of the inner-conductor-formed holes 2*a* to 2*j*. The other structural parts are the same as those shown in the case of the first embodiment.

Figure 7:
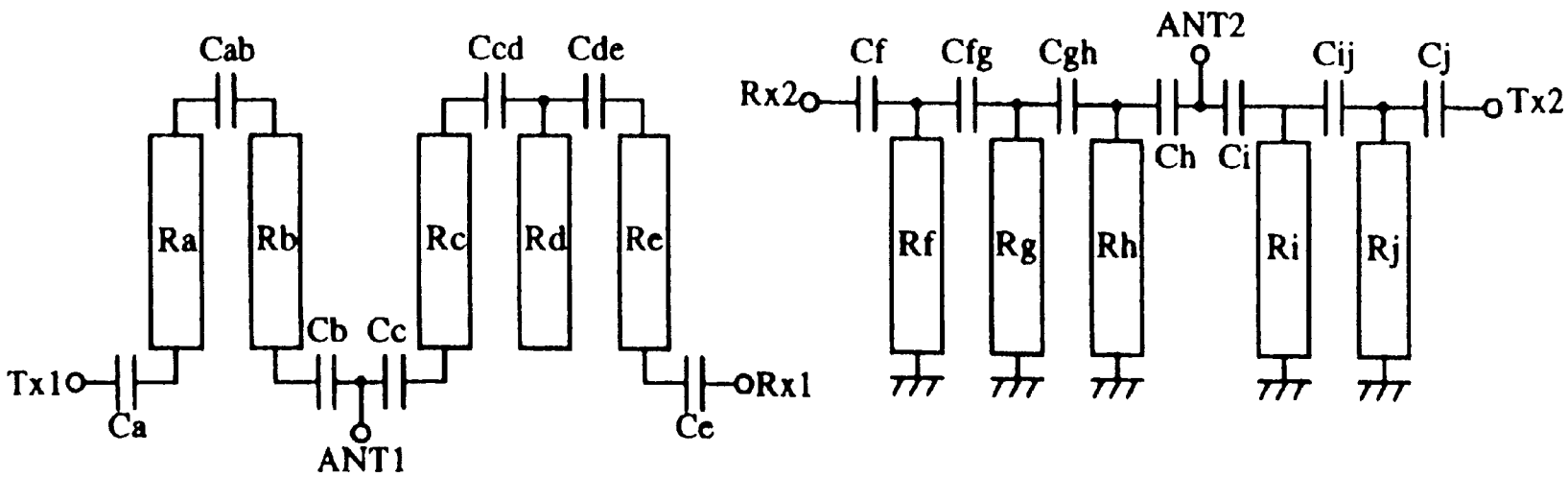
FIG. 7 is an equivalent circuit diagram of the dielectric duplexer of the third embodiment.

FIG. 7 is an equivalent circuit diagram of the dielectric duplexer shown in FIG. 6. In this figure, reference character Cab denotes a capacitor generated between coupling electrodes 6*a* and 6*b*, reference character Ccd denotes a capacitor generated between the coupling electrodes 6*c* and 6*d*, and reference character Cde denotes a capacitor generated between the coupling electrodes 6*d* and 6*e*. Similarly, reference character Cfg denotes a capacitor generated between the coupling electrodes 6*f* and 6*g*, reference character Cgh denotes a capacitor generated between the coupling electrodes 6*g* and 6*h*, and reference character Cij denotes a capacitor generated between the coupling electrodes 6*i* and 6*j*. The other structural parts are the same as those shown in the first embodiment.

In the first to third embodiments, the terminal electrodes 5*a*, 5*b*, and 5*c* are disposed near the open face different from that near which the terminal electrodes 5*e*, 5*f*, and 5*g* are disposed. However, the terminal electrodes 5*a*, 5*b*, and 5*c*, and the remaining terminal terminals 5*e*, 5*f*, and 5*g* may be aligned together. The former arrangement has an advantage in that, since two systems comprised of the terminal electrodes are isolated from each other, mutual interference can be suppressed, whereas the latter arrangement has an advantage in that circuits of the two systems can be easily placed on a printed circuit board, on which the dielectric duplexer is mounted.

Next, a description will be given of a dielectric filter according to a fourth embodiment of the present invention with reference to FIGS. 8 and 9.

Figure 8A:
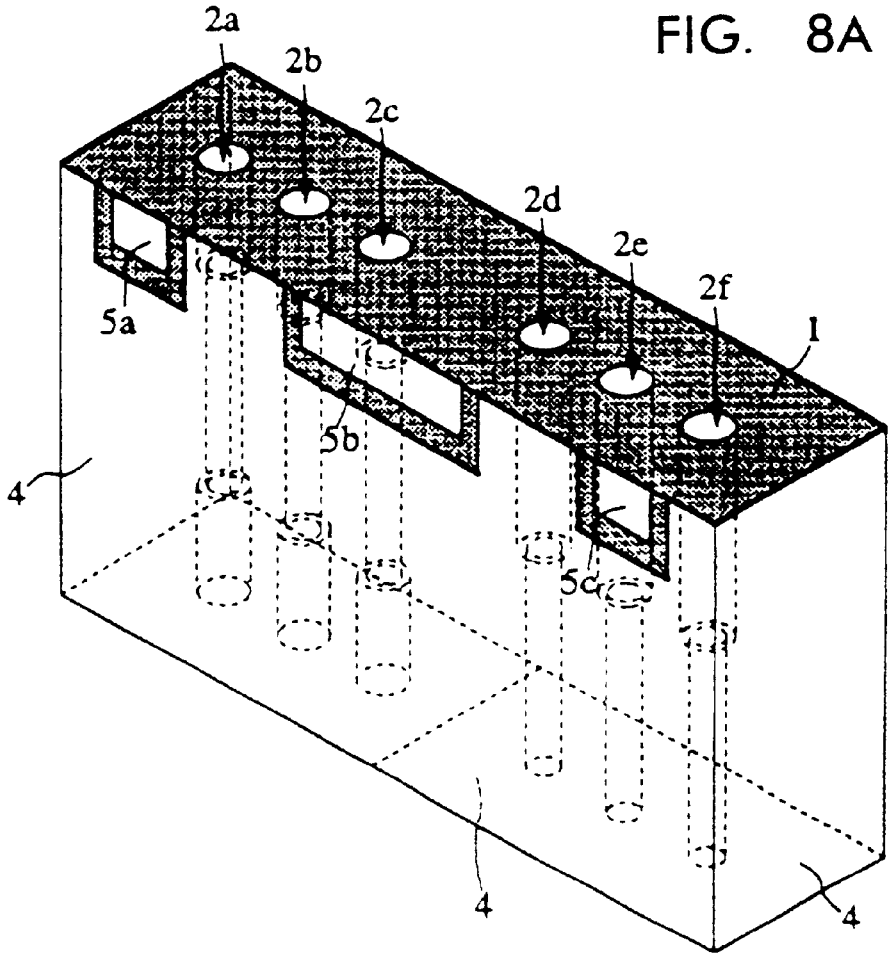
FIG. 8A shows a perspective view of a dielectric filter according to a fourth embodiment of the present invention.
Figure 8B:
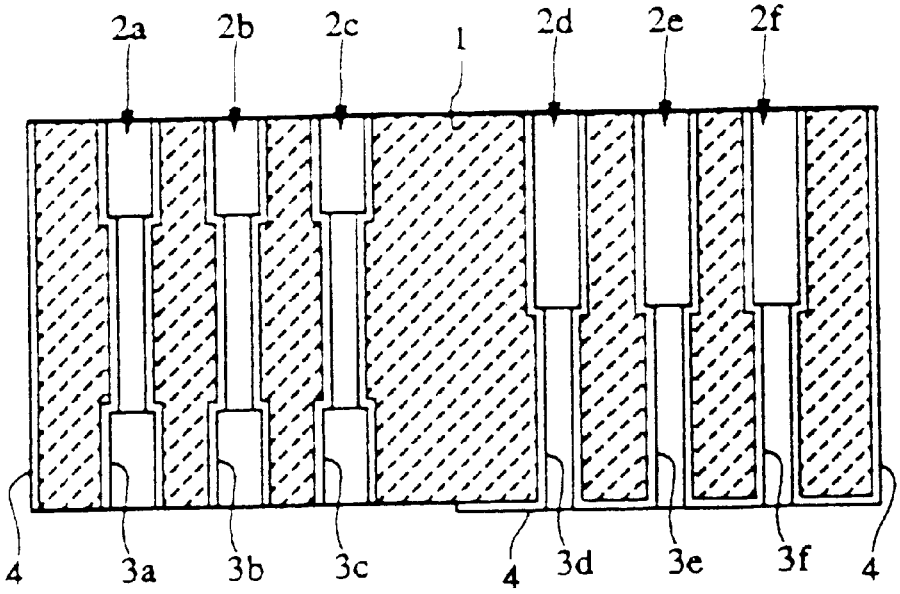
FIG. 8B shows a sectional view thereof.

FIG. 8A shows a perspective view of the appearance of the dielectric filter in a vertical orientation in such a manner that the front-left-side surface of the structure is set as a surface to be mounted on a printed circuit board, and FIG. 8B shows a sectional view taken by a plane passing along the central axes of inner-conductor-formed holes of the dielectric filter. Unlike the case of the first embodiment, in the fourth embodiment, two pairs of reception filters are disposed in a dielectric block 1.

As shown in FIG. 8, inside the dielectric block 1, inner-conductor-formed holes 2*a* to 2*f* are disposed. On the inner surfaces of the inner-conductor-formed holes 2*a* to 2*f*, inner conductors 3*a* to 3*f* are formed. An outer conductor 4 is each formed on four side surfaces of the dielectric block 1 and on one of the open faces of each of the inner-conductor-formed holes 2*d* to 2*f*. Furthermore, on the front-left-side surface of the dielectric block 1 shown in FIG. 1A, terminal electrodes 5*a*, 5*b*, and 5*c* isolated from the outer conductor 4 are formed.

With this arrangement, the inner conductors 3*a* to 3*c* act as λ/2 resonators which resonate at a ½ wavelength, each end of the resonators being open-circuited, and the inner conductors 3*d* to 3*f* act as λ/4 resonators which resonate at a ¼ wavelength, one end of each of the resonators being short-circuited.

Figure 9:
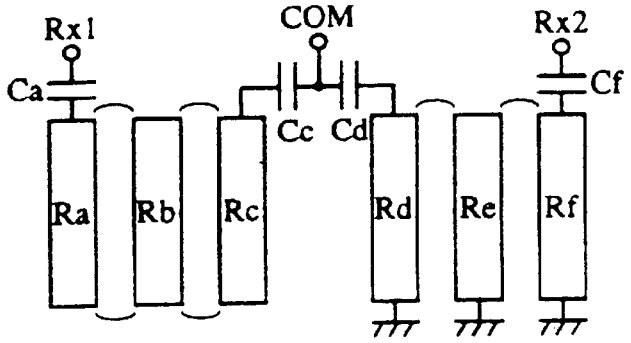
FIG. 9 is an equivalent circuit diagram of the dielectric filter of the fourth embodiment.

FIG. 9 is an equivalent circuit diagram of the above dielectric filter. In this figure, reference characters Ra to Rf denote resonators formed by the inner conductors 3*a* to 3*f*. Reference characters Ca and Cf denote capacitors generated between the vicinity of one of the open faces of each of the inner conductors 3*a* and 3*f* and terminal electrodes 5*a* and 5*c*, and reference characters Cc and Cd denote capacitors generated between the vicinity of one of the open faces of each of the inner conductors 3*c* and 3*d* and a terminal electrode 5*b*.

The three-stage resonators Ra to Rc act as a first reception filter, and the three-stage resonators Rd to Rf act as a second reception filter. As a result, the terminal electrodes 5*a*, 5*b*, and 5*c* shown in FIG. 8A are used as a first reception output terminal Rx1, a common input terminal COM, and a second reception output terminal Rx2, respectively, to form a reception filter (a diplexer) adaptable to two frequency bands.

In each of the above embodiments, the dielectric block used is formed of a single dielectric. However, dielectrics having different dielectric constants may be used for the first frequency band filter constituted of λ/2 resonators and the second frequency band filter constituted of λ/4 resonators. For example, in the dielectric duplexer shown in FIG. 1, a dielectric block into which dielectrics having different dielectric constants according to areas are integrated may be used, and the inner-conductor-formed holes 2*a* to 2*e* may be formed in an area having a dielectric constant different from that of an area where the inner-conductor-formed holes 2*f* to 2*j* are formed. With this arrangement, since the frequency ratio between the first dielectric duplexer and the second dielectric duplexer is not limited to a ratio of 1:2, the frequency ratio can be set at an arbitrary ratio.

In the above embodiments, the dielectric filter and the dielectric duplexer are formed by disposing the conductor films on and in the dielectric block. However, the dielectric filter and the dielectric duplexer of the invention may be obtained by forming a conductor film on a dielectric plate and disposing a resonator constituted of a micro-stripline thereon.

Figure 10A:
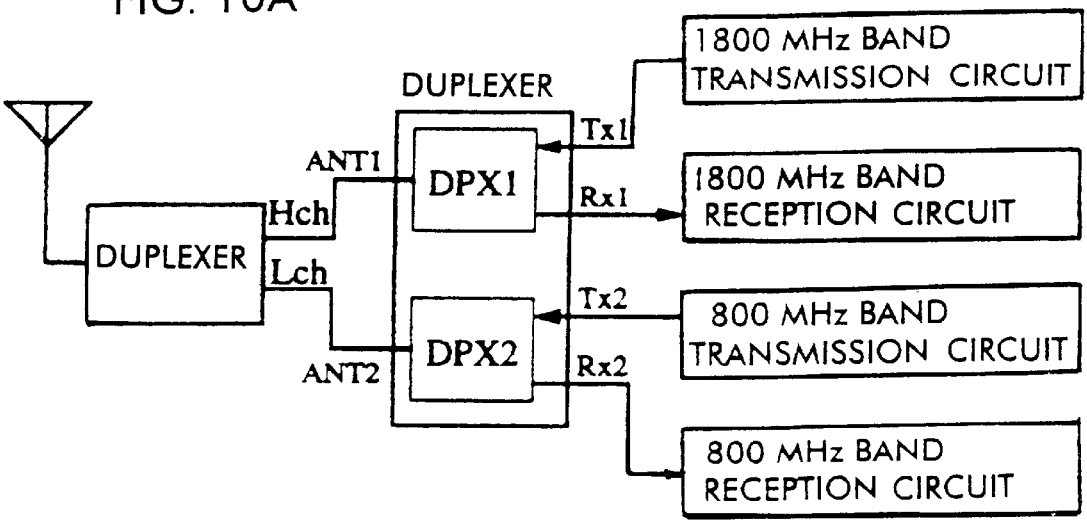
FIGS. 10A and 10B show block diagrams showing the structures of communication apparatuses according to a fifth embodiment of the present invention.

Next, a description will be given of the structures of two communication apparatuses according to a fifth embodiment with reference to FIGS. 10A and 10B. A duplexer shown in FIG. 10A is the dielectric duplexer shown in one of the first to third embodiments. In this figure, a diplexer is a filter performing synthesis/separation of a high channel Hch (1800 MHz band) and a low channel (800 MHz band) Lch. The high channel Hch is connected to a first antenna terminal ANT1 of a first duplexer, and the low channel Lch is connected to a second antenna terminal ANT2 of a second duplexer. Terminals Tx1 and Rx1 of the first duplexer are connected to a transmission circuit of the 1800 MHz band and a reception circuit of the 1800 MHz band, respectively. Terminals Tx2 and Rx2 of the second duplexer are connected to a transmission circuit of the 800 MHz and a reception circuit of the 800 MHz band, respectively.

Figure 10B:
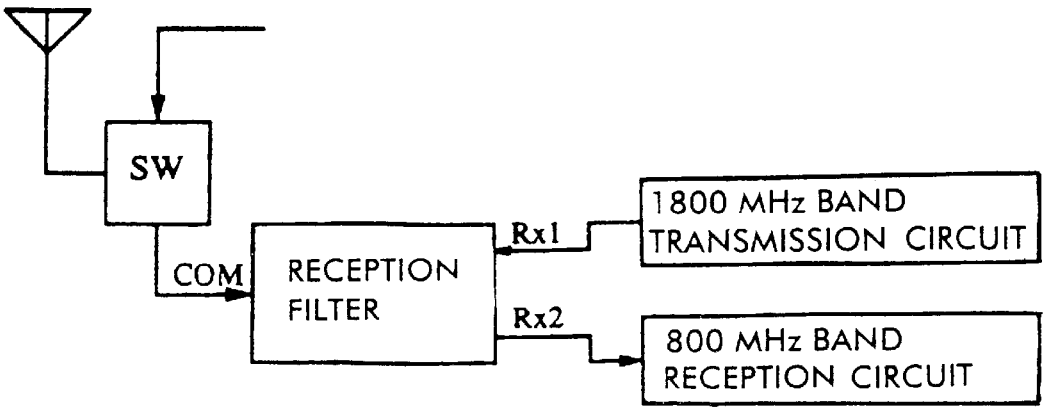

A reception filter shown in FIG. 10B is the filter shown in the fourth embodiment. In addition, reference character SW denotes a switch for performing the time-division-multiplexing of a transmission signal and a reception signal. A reception signal output port of the switch SW is connected to a common terminal of the reception filter, a first reception signal output terminal Rx1 of the reception filter is connected to a reception circuit of 1800 MHz band, and a second reception signal output terminal Rx2 of the reception filter is connected to a reception circuit of 800 MHz band.

In this way, by using the duplexer and the filter adapted to two frequency bands, an overall compact communication apparatus can be produced.

As described above, according to one aspect of the present invention, a compact dielectric filter respectively adapted to two frequency bands can be obtained by forming a first filter constituted of the plurality of λ/2 resonators and a second filter constituted of the plurality of λ/4 resonators by using a single dielectric member and a conductor films formed thereon and therein.

In addition, since the lengths of the λ/2 resonators and the λ/4 resonators are substantially equal, for example, when a dielectric filter is formed by using a rectangular-parallelepiped dielectric block, since no stepped portion is not generated, no crack is produced in the dielectric block. Furthermore, since the dielectric block and the completed dielectric filter can be easily grasped, production of the dielectric filter and mounting the filter on a printed circuit board can be facilitated.

In addition, since the frequency ratio between the first filter and the second filter is not limited to the ratio of 1:2 so that the ratio can be an arbitrary frequency ratio, a dielectric filter adaptable to an appropriate communication system can be easily obtained.

In addition, by disposing inner-conductor-formed holes serving as the λ/2 resonators and the λ/4 resonators in parallel with each other, structuring of the dielectric block and formation of the conductor film on the dielectric block can be facilitated.

According to another aspect of the present invention, a compact dielectric duplexer, which can be used as an antenna duplexer adaptable to two frequency bands, can be obtained.

According to another aspect of the present invention, since a compact high-frequency circuit section can be formed, an overall compact communication apparatus is obtainable.

What is claimed is:

1. A dielectric filter comprising a single dielectric member of substantially continuous rectangular external shape;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators.

2. A dielectric filter according to claim 1, wherein line impedances of open-circuited ends of the λ/2 resonators and the λ/4 resonators are respectively different from those of short-circuited ends thereof so that resonance frequencies of the λ/2 resonators and the λ/4 resonators have specified values corresponding to said respective impedances, whereas lengths of the λ/2 resonators and the λ/4 resonators are substantially equal.

3. A dielectric filter comprising a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein line impedances of open-circuited ends of the λ/2 resonators and the λ/4 resonators are respectively different from those of short-circuited ends thereof so that resonance frequencies of the λ/2 resonators and the λ/4 resonators have specified values corresponding to said respective impedances, whereas lengths of the λ/2 resonators and the λ/4 resonators are substantially equal; and wherein the dielectric constant of the first frequency band filter comprised of the λ/2 resonators differs from the dielectric constant of the second frequency band filter comprised of the λ/4 resonators.

4. A communication apparatus comprising:

a high-frequency circuit comprising at least one of a transmitting circuit and a receiving circuit, and a dielectric filter connected to said high-frequency circuit, said dielectric filter comprising:

a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein the dielectric constant of the first frequency band filter comprised of the λ/2 resonators differs from the dielectric constant of the second frequency band filter comprised of the λ/4 resonators.

5. A dielectric duplexer comprising a pair of dielectric filters, each having a pair of input-output electrodes, respective ones of said input-output electrodes in each of said filters being connected together, each of said dielectric filters comprising:

a single dielectric member of substantially continuous rectangular external shape;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators.

6. A dielectric duplexer according to claim 5, wherein line impedances of open-circuited ends of the λ/2 resonators and the λ/4 resonators are respectively different from those of short-circuited ends thereof so that resonance frequencies of the λ/2 resonators and the λ/4 resonators have specified values corresponding to said respective impedances, whereas lengths of the λ/2 resonators and the λ/4 resonators are substantially equal.

7. A dielectric filter comprising a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein the dielectric constant of the first frequency band filter comprised of the λ/2 resonators differs from the dielectric constant of the second frequency band filter comprised of the λ/4 resonators.

8. A dielectric filter according to one of claims 1, 2, 3 and 7, wherein the resonators are formed in said single dielectric member by a corresponding plurality of dielectric coaxial resonators having respective holes with corresponding inner conductors disposed in parallel with each other.

9. A dielectric duplexer comprising a pair of dielectric filters, each having a pair of input-output electrodes, respective ones of said input-output electrodes in each of said filters being connected together, each of said dielectric filters comprising:

a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein line impedances of open-circuited ends of the λ/2 resonators and the ¼ resonators are respectively different from those of short-circuited ends thereof so that resonance frequencies of the λ/2 resonators and the λ/4 resonators have specified values corresponding to said respective impedances, whereas lengths of the λ/2 resonators and the λ/4 resonators are substantially equal; and wherein the dielectric constant of the first frequency band filter comprised of the λ/2 resonators differs from the dielectric constant of the second frequency band filter comprised of the λ/4 resonators.

10. A dielectric duplexer comprising a pair of dielectric filters, each having a pair of input-output electrodes, respective ones of said input-output electrodes in each of said filters being connected together, each of said dielectric filters comprising:

a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein the dielectric constant of the first frequency band filter comprised of the λ/2 resonators differs from the dielectric constant of the second frequency band filter comprised of the λ/4 resonators.

11. A dielectric duplexer according to one of claims 5, 6, 9, and 10, wherein the resonators are formed in said single dielectric member by a corresponding plurality of dielectric coaxial resonators having respective holes with corresponding inner conductors disposed in parallel with each other.

12. A communication apparatus comprising:

a high-frequency circuit comprising at least one of a transmitting circuit and a receiving circuit, and a dielectric filter connected to said high-frequency circuit, said dielectric filter comprising:

a single dielectric member of substantially continuous rectangular external shape;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators.

13. A communication apparatus according to claim 12, wherein line impedances of open-circuited ends of the λ/2 resonators and the λ/4 resonators are respectively different from those of short-circuited ends thereof so that resonance frequencies of the λ/2 resonators and the λ/4 resonators have specified values corresponding to said respective impedances, whereas lengths of the λ/2 resonators and the λ/4 resonators are substantially equal.

14. A communication apparatus comprising:

a high-frequency circuit comprising at least one of a transmitting circuit and a receiving circuit, and a dielectric filter connected to said high-frequency circuit, said dielectric filter comprising:

a single dielectric member;

a first frequency band filter in the single dielectric member comprising a plurality of λ/2 resonators resonating at a length of ½ wavelength at a first frequency, both ends of each of the λ/2 resonators being either open-circuited or short-circuited;

a second frequency band filter in the single dielectric member comprising a plurality of λ/4 resonators resonating at a length of ¼ wavelength at a second frequency, one end of the λ/4 resonators being short-circuited, and the other end thereof being open-circuited; and conductor films formed on the single dielectric member and therein to form the plurality of λ/2 resonators and the plurality of λ/4 resonators;

wherein line impedances of open-circuited ends of the λ/2 resonators and the λ/4 resonators are respectively different from those of short-circuited ends thereof so that resonance frequencies of the λ/2 resonators and the λ/4 resonators are substantially equal; and wherein the dielectric constant of the first frequency band filter comprised of the λ/2 resonators differs from the dielectric constant of the second frequency band filter comprised of the λ/4 resonators.

15. A communication apparatus according to one of claims 12, 13, 14 and 4, wherein the resonators are formed in said single dielectric member by a corresponding plurality of dielectric coaxial resonators having respective holes with corresponding inner conductors disposed in parallel with each other.

* * * * *